US005661489A

United States Patent [19]

Baker

[11] Patent Number: 5,661,489

[45] Date of Patent: Aug. 26, 1997

[54] ENHANCED ELECTRONICALLY STEERABLE BEAM-FORMING SYSTEM

[75] Inventor: Leonard Baker, Bethesda, Md.

[73] Assignee: QuesTech, Inc., Falls Church, Va.

[21] Appl. No.: 638,099

[22] Filed: Apr. 26, 1996

[51] Int. Cl.[6] ..... H01Q 3/24; H01Q 3/26

[52] U.S. Cl. ..... 342/373; 342/154; 342/380; 342/383; 333/81 R

[58] Field of Search ..... 342/154, 372, 342/373, 362, 380, 383; 333/81 R

[56] References Cited

U.S. PATENT DOCUMENTS

| | | | |
|---|---|---|---|
| 2,995,752 | 8/1961 | Shyhalla et al. | 343/114 |
| 3,665,479 | 5/1972 | Silliman | 343/726 |
| 3,670,335 | 6/1972 | Hirsch | 343/100 SA |
| 3,697,994 | 10/1972 | O'Daniel | 343/16 R |
| 3,725,929 | 4/1973 | Spanos | 343/844 |
| 3,821,740 | 6/1974 | Ehrlich | 343/100 SA |
| 4,032,922 | 6/1977 | Provencher | 343/854 |
| 4,313,220 | 1/1982 | Lo et al. | 455/304 |
| 4,516,126 | 5/1985 | Masak et al. | 343/383 |
| 4,965,588 | 10/1990 | Lenormand et al. | 342/372 |
| 4,977,382 | 12/1990 | Podell et al. | 333/16 X |
| 4,983,981 | 1/1991 | Feldman | 342/372 |
| 5,081,463 | 1/1992 | Hariu et al. | 342/372 |
| 5,099,247 | 3/1992 | Basile et al. | 342/380 |
| 5,162,803 | 11/1992 | Chen | 342/372 |
| 5,162,804 | 11/1992 | Uyeda | 342/373 |
| 5,166,690 | 11/1992 | Carlson et al. | 342/157 |

*Primary Examiner*—Thomas H. Tarcza
*Assistant Examiner*—Dao L. Pham
*Attorney, Agent, or Firm*—Joseph Scafetta, Jr.; Alan W. Young

[57] ABSTRACT

A beam electronically steers, in real time, a multielement sensor array at radio frequencies. A sensor array is configured in one embodiment with orthogonal loops and orthogonal dipole elements. Each loop and dipole combination generates a polarized output signal which is routed, via a connection matrix, to an equal number of signal splitters. The resulting modal patterns are then routed to networks having quad hybrids and digitally user-controllable vector modulators. The signals outputted from the quad hybrids and the vector modulators of each of the networks are inputted to separate combiners. The signals outputted from the separate combiners of the networks are then recombined in combiners. The signals outputted from these combiners define the azimuth around the Z-axis, the elevation around the Y-axis, and the elevation around the X-axis, respectively. These signals are finally combined in a signal combiner, which output is only then sent to one or more receivers, after further filtering and amplifying, if desired.

20 Claims, 7 Drawing Sheets

ENHANCED ELECTRONICALLY STEERABLE BEAM-FORMING SYSTEM

BACKGROUND OF THE INVENTION

1. Field of the Invention

The present invention relates to an electronically steerable beam-forming system. Specifically, the present invention is a system for forming independently steerable wide band cardioid radiation patterns.

2. Description of the Related Art

The tactical electromagnetic environment at a high frequency (HF) level has been found to be extremely hostile to communication. Examples of the factors which render this environment hostile are: limitations in the receiver due to poor sensitivity; multipath and multimode propagation; co-channel and adjacent channel interferors; and jammers, whether friendly or hostile.

In an effort to jam interferors or to receive a desired signal in the presence of a jamming signal, various beam-forming techniques have been developed to minimize unwanted directional signals or to maximize desired signals in the presence of noise. These conventional techniques have concentrated on signal processing at the intermediate frequency (IF) level.

However, signal processing at the IF level is usually limited to a narrow frequency band. Furthermore, some approaches to develop nulls automatically have centered on the use of linear feedback techniques to find, for example, the location of jamming emitters.

The aforementioned IF processing technique requires a reasonably high signal-to-noise (S/N) ratio typically on the order of six or higher decibels (dBs), and does not work well if the S/N ratio drops to three dBs or less. Signal processing at the IF level imposes limitations also on the band width of the developed nulls, thus decreasing the utility and effectiveness of receivers employing this technique.

For example, if wide band deep nulls could be created directly from the signals induced on an antenna array, before the received signal is transmitted to the receiver, the band limitations imposed by conventional IF processing techniques would be overcome.

Indeed, analog radio frequency (RF) processing would provide wide bandwidth advantages which are not currently attainable at IF levels with digital processing approaches due primarily to the bandwidth/sampling limitations imposed by analog-to-digital (A/D) converters, and the weight, space and power requirements on board real host platforms. The broadband nature of analog spatial processing techniques makes it ideally suited for applications in broadband systems.

SUMMARY AND OBJECTS OF THE INVENTION

It is a primary object of the present invention to receive and make use of signals, irrespective of their polarization, by exploiting all elements of an antenna array arrangement in a polarizationally diverse manner.

It is another primary object of the present invention to provide an electronically steerable beam-forming system wherein both azimuth and elevation are controlled using a multielement sensor array.

It is another object of the present invention to provide electromagnetic array beams formed by combinations of modal antenna patterns.

It is an additional object of the present invention to provide a new apparatus for intercepting a radio signal of unknown origin.

It is a further object of the present invention to perform signal processing directly on signals induced on a sensor array, that is, at the RF, rather than on the IF level.

It is still a further object of the present invention to provide a system using a multielement antenna array for direction finding (DF) purposes in real time and without translating the signals down to the IF range.

It is still a further object of the present invention to steer electronically in a beam pattern of a sensor array to form a wide frequency bandwidth cardioid pattern with deep nulls by utilizing a vector modulator to process the induced RF signal in real time.

It is yet another object of the present invention to modify the angular position of a broadband cardioid sensor array pattern into any one of four quadrants about a particular axis by attenuating, with a high degree of resolution, a split broadband signal using digital control words.

It is an additional object of the present invention to allow the antenna pattern null interpolation between two known, previously stored, null-producing parameters.

BRIEF DESCRIPTION OF THE DRAWINGS

The objects and features of the present invention will become more apparent from the consideration of the following detailed description of a decomposition of a common phase centered structure having three dipoles and three loops, all spacially orthogonal to each other, taken in conjunction with the accompanying drawings.

DETAILED DESCRIPTION OF THE PREFERRED EMBODIMENTS

Figure 2:
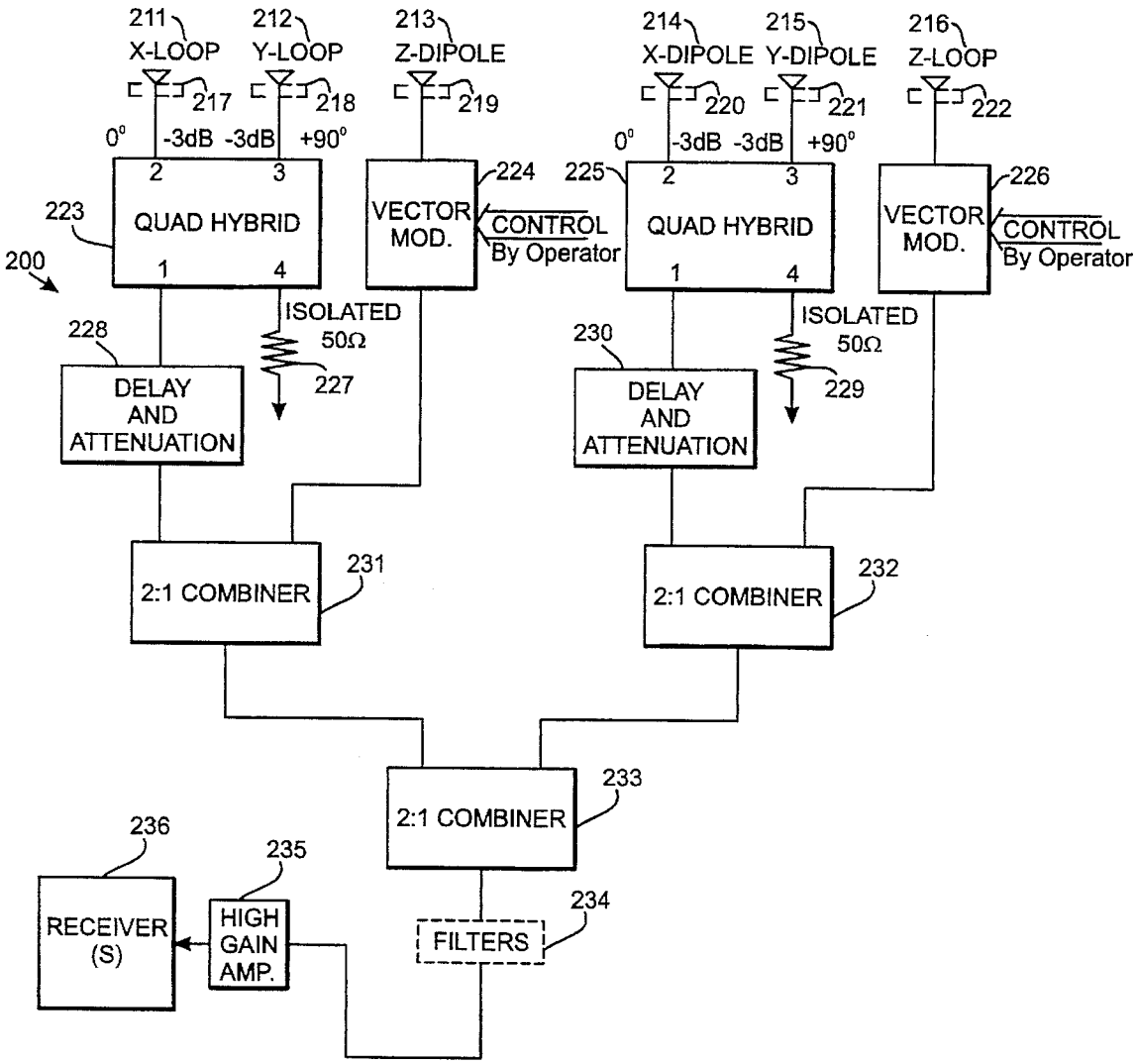
FIG. 2 depicts schematically a first embodiment of an enhanced electronically steerable beam-forming system according to the present invention.
Figure 5:
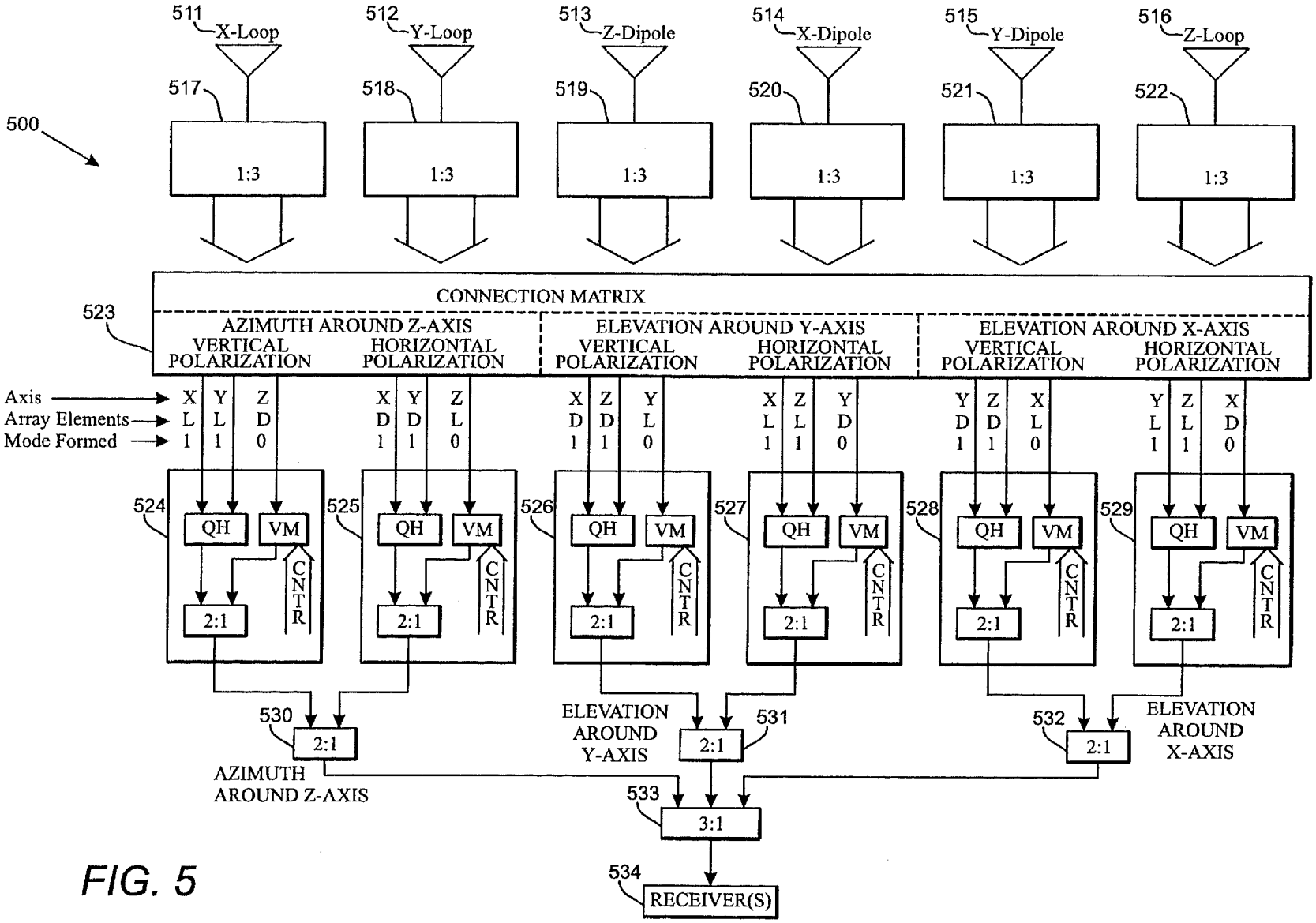
FIG. 5 shows schematically a second embodiment of the enhanced electronically steerable beam-forming system according to the present invention.

The present invention uses an array of three dipole antennas orthogonal to one another and three loop antennas, also orthogonal to one another, in two preferred embodiments shown in FIGS. 2 and 5. The three dipoles and the three loops may be co-located, but also may be separated from each other, without substantially affecting the operation of the present invention. Preferably, the orthogonal small-aperture dipoles are approximately one-tenth of a wavelength long ($\lambda/10$). This size makes them very inefficient, but extremely broadband. The orthogonal small-aperture loops are preferably antennas which are aligned along two perpendicular axes in the loop plane. Their small apertures make these antennas extremely wide band, at the expense of gain. Of course, antennas or other sensors, transducers of other sizes or configurations may be used without departing from the spirit and scope of the present invention.

Figure 1A:
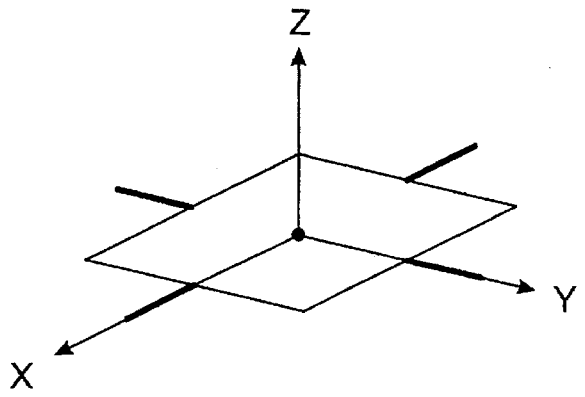
FIG. 1*a* is a graphical representation of an antenna array portion of a means to develop a horizontally polarized cardioid pattern about the Z-axis (azimuth).
Figure 1B:
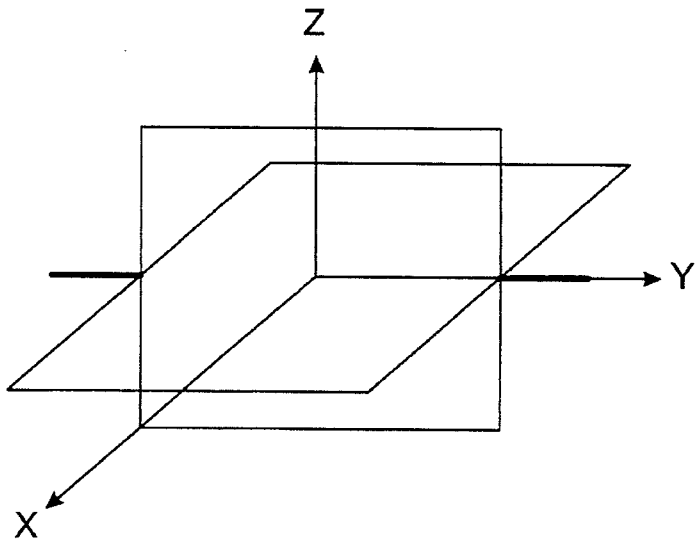
FIG. 1*b* is a graphical representation of an antenna array portion of a means to develop a horizontally polarized cardioid pattern about the Y-axis (elevation).
Figure 1C:
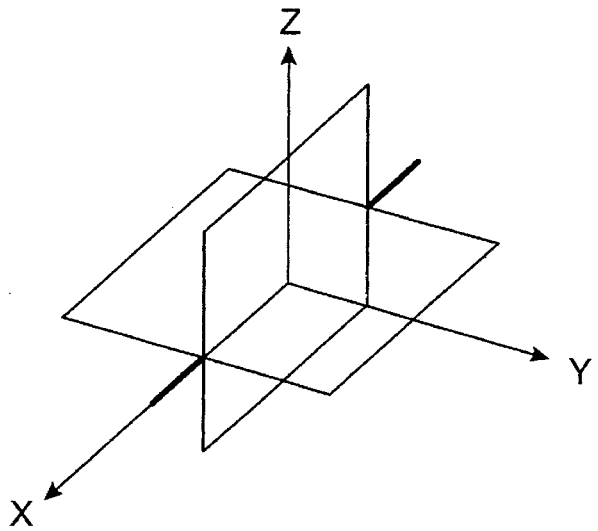
FIG. 1*c* is a graphical representation of an antenna array portion of a means to develop a horizontally polarized cardioid pattern about the X-axis (elevation).

FIGS. 1*a* through 1*c* depict elevation and azimuth around X-, Y- and Z-axes using horizontal polarization. Horizontal polarization refers to the case wherein transmission of radio waves with a plane wave front occurs so that electric lines of force are horizontal, while magnetic lines of force are vertical. With horizontal polarization, both transmitting and receiving antennas are placed in a horizontal plane with respect to the surface of the Earth.

Figure 1D:
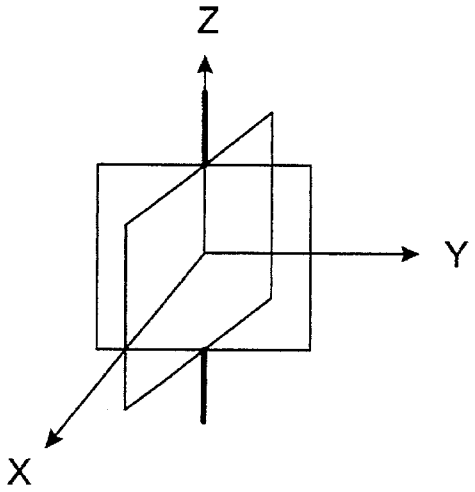
FIG. 1*d* is a graphical representation of an antenna array portion of a means to develop a vertically polarized cardioid pattern about the Z-axis (azimuth).
Figure 1E:
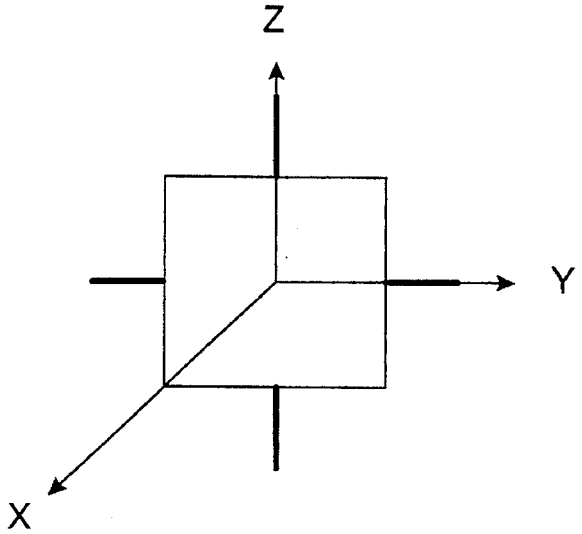
FIG. 1*e* is a graphical representation of an antenna array portion of a means to develop a vertically polarized cardioid pattern about the X-axis (elevation).
Figure 1F:
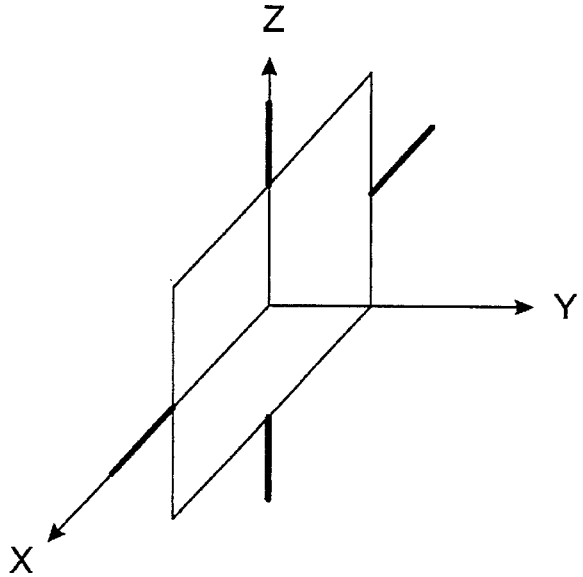
FIG. 1*f* is a graphical representation of an antenna array portion of a means to develop a vertically polarized cardioid pattern about the Y-axis (elevation).

Likewise, for a plane wave front, FIGS. 1*d* through 1*f* show elevation and azimuth around the X-, Y- and Z-axes using vertical polarization. Vertical polarization refers to the case wherein the electric lines of force are vertical, while the magnetic lines of force are horizontal. With vertical polarization, both receiving and transmitting antennas are oriented in a vertical plane with respect to the surface of the Earth.

A brief description of modal antenna patterns follows. This description will aid in a proper understanding of the present invention.

Mode 0 is obtained, for example, from a signal transmitted from a single dipole antenna. As one goes around the dipole axis, there will be no change in any phase of a carrier signal with respect to itself. For this reason, Mode 0 is used as a phase reference. Mode 1 can be obtained, for example, using two dipole antennas in spacial quadrature while combining the dipole signals in time-phase quadrature. With Mode 1, there is one degree of carrier phase shift for every degree of azimuth angle, with respect to Mode 0. Likewise, with more complex antenna arrays, Modes 2 and 3 are two and three degrees, respectively, of phase shift for every degree of azimuth angle change, respectively, again with regard to Mode 0. Modes beyond Mode 1 exhibit angular ambiguities due to the cyclic nature of the signal. These ambiguities can be resolved by referring to Mode 1. Higher modes, however, give increased angular sensitivity.

FIG. 2 shows a first embodiment of an enhanced electronically steerable beam-forming system 200. As can be seen from FIG. 2, the present invention operates at a front end, i.e. directly on the signals induced on the antennas or sensors, and not at either a receiver baseband signal level or an IF signal level.

An X-loop 211, a Y-loop 212, and a Z-dipole 213 are used for vertical polarization, while an X-dipole 214, a Y-dipole 215, and a Z-loop 216 are used for horizontal polarization. Optionally, a series of bandpass filters 217, 218, 219, 220, 221, and 222 may be used to limit signals induced on antenna elements to a frequency band of interest. It is important, in order not to corrupt incoming signals, that any bandpass filter to be used must be wideband and very linear in phase, all having the same time delay. Upper and lower cut-off frequencies of these bandpass filters would, of course, be adjusted according to a desired broadband signal, as is well known in the art. Another option that would avoid any attenuation of the incoming signal and would not induce any phase shift, is not to use any bandpass filters at all.

The X- and Y-loops 211 and 212, as well as the X- and Y-dipoles 214 and 215, are then input to quadrature hybrids 223 and 225, respectively.

A quadrature hybrid combiner operates on two signals so that their phase spectral contents are in quadrature (i.e. 90 degrees apart) while their spectral amplitudes are invariant. Thereafter, the output signal represents the summation of the two transformed signals. The accuracy of the quadrature hybrid is very important. For best results, high-phase accuracy over the full military temperature range is desired. Such accuracy should be maintained over a wide band frequency range.

In each of the quadrature hybrids 223 and 225 shown in FIG. 2, there is a 0 degree input and a +90 degree input, the sum of which appears at terminal 1, while no signal appears at terminal 4 which is connected to a common RF potential through 50-ohm (Ω) resistors 227 and 229. Outputs at terminal 1 of the quadrature hybrids 223 and 225 are Mode 1 signals. In other words, the outputs are signals of constant amplitude with a carrier phase which is shifted one degree for every degree of azimuth angle shift with respect to the Mode 0 signal appearing at the output terminals of the Z-dipole 213 and the Z-loop 216.

Figure 3:
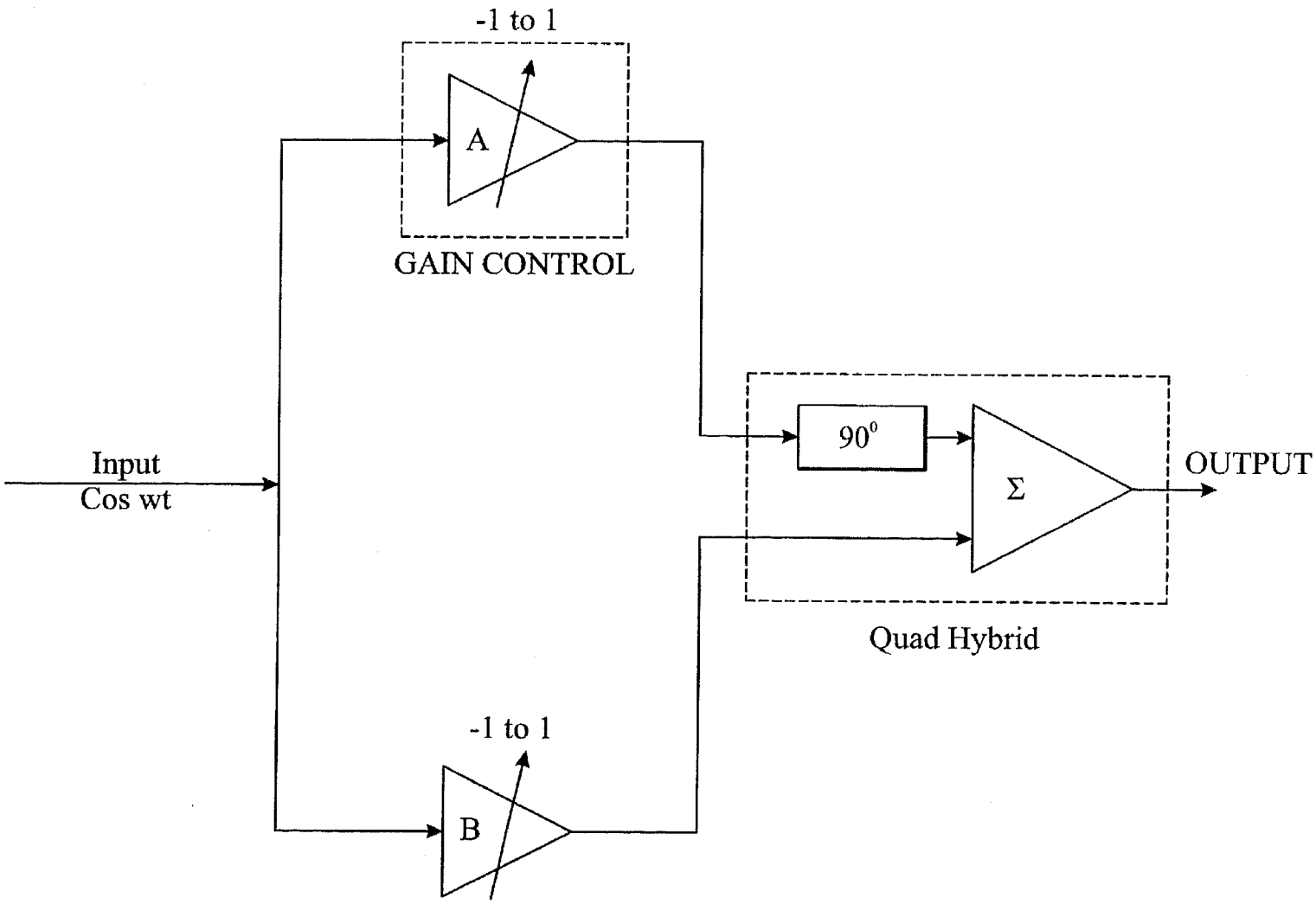
FIG. 3 is a conceptual diagram of a vector modulator according to the present invention.

The Z-dipole 213 and the Z-loop 216 are connected to vector modulators 224 and 226, respectively, which take an electromagnetic signal of interest at the input, and output the same signal, albeit delayed, with a changed amplitude and a shifted phase with respect to the input signal. The structure of the vector modulators 224 and 226 is shown conceptually in FIG. 3 and in detail with reference to FIG. 4.

The vector modulators 224 and 226 are capable of changing the amplitude of the input signal over a range greater than 80 decibels with an accuracy within 0.1 dB. Furthermore, the phase shift is controllable within much less than one-tenth of a degree. The amplitude and the phase shift at the output of the vector modulators 224 and 226 are controllable from a series of vector control words A1, A2, B1 and B2. These control words also will be further described with reference to FIG. 4.

Thus, returning to FIG. 2, it may be seen that the vector modulators 224 and 226 output a changed magnitude and a phase-shifted Mode 0 signal since the signal output therefrom originated from only one sensor element, i.e., in this embodiment, the Z-dipole antenna 213 and the Z-loop antenna 216, respectively.

The output from the quadrature hybrids 223 and 225 are input to a pair of delay and attenuator devices 228 and 230, respectively. The reason for using the devices 228 and 230 is that the phase shifts and magnitude changes induced in the quadrature hybrids 223 and 225 and the vector modulators 224 and 226 are unequal. To compensate for these unequal magnitude changes and phase shifts, a delay line and an attenuator are inserted at the output of the quadrature hybrids 223 and 225. Thus, the delay and attenuator devices 228 and 230 are preferably implemented using a one-point or higher order transversal filter.

The Mode 1 signals outputted from the delay and attenuator devices 228 and 230, and the modified Mode 0 signals outputted from the vector modulators 224 and 226 are combined in 2:1 combiners 231 and 232, respectively.

A useful description for characterizing modal patterns is to liken them to spacial Fourier components. If the signals inputted to the 2:1 combiners 231 and 232 are approximately the inverse of each other, an approximate null signal will be produced.

Similarly, the outputs of the 2:1 combiner 231 operating on a vertically polarized channel and the 2:1 combiner 232 operating on a horizontally polarized channel are again combined in another 2:1 combiner 233. If both vertically and horizontally polarized channels are nulled out, then a null has been created in a polarizationally diverse manner. Therefore, by carefully choosing and setting the vector control words A1, A2, B1, and B2 of the vector modulators 224 and 226, a deep null can be electronically steered to any azimuth angle. Since the vector control words are set by a computer 434 shown in FIG. 4 land also since such control words can be changed at millisecond intervals or faster, the net effect is to swing the entire CART antenna array to any azimuth angle in fractions of milliseconds.

Optionally, a broadband signal output from the 2:1 combiner 233 is input to one or more filters 234 shown in dashed lines in FIG. 2. These filters 234 are, of course, configured according to the particular application at hand. For example, in the case where a known frequency-limited signal is present and undesirable, e.g., a broadcasting station, a bandreject filter tuned to a known frequency can be switched into the circuit to eliminate this signal before it is inputted to a receiver 236. This tunable bandreject filter would produce a fixed null independent of the electronically steerable null.

The output of the tunable filters 234 is inputted to a high gain amplifier 235, the output of which is fed to the receiver 236. If the high gain amplifier 235 is to be output to more than one receiver 236, then signal splitters (not shown) of an appropriate ratio are used, as is well known in the art.

Thus, it is important to note that all of the above-described devices are located between the antenna array and the receiver 236 of the system. In other words, all signal processing occurs at the front end, i.e., at the RF level, before the signal is inputted into the receiver 236 or translated down to an IF level.

As mentioned previously, FIG. 4 illustrates a preferred embodiment of a vector modulator 400 according to the present invention. As also stated earlier, the vector modulator 400 takes a signal at the input and changes the Fourier components of the signal by modifying the magnitude and the phase of the components. Means for modifying these components are a real channel 450 and an imaginary channel 460 combined in quadrature by the quad hybrid 432.

The extent of amplitude change is determined in part from the attenuation controlled by the vector control words A1, A2, B1, and B2 set by the computer 434, and in part from the attenuation in the constituent parts of the vector modulator 400, for example, the signal splitters, as will be described below. Likewise, the extent of any delay that the signal experiences is the sum of the propagation delays of the signal through each element of the vector modulator 400. The signal splitters exhibit a very small delay, but have an extremely wide bandwidth, typically in excess of 500 MHz.

Figure 4:
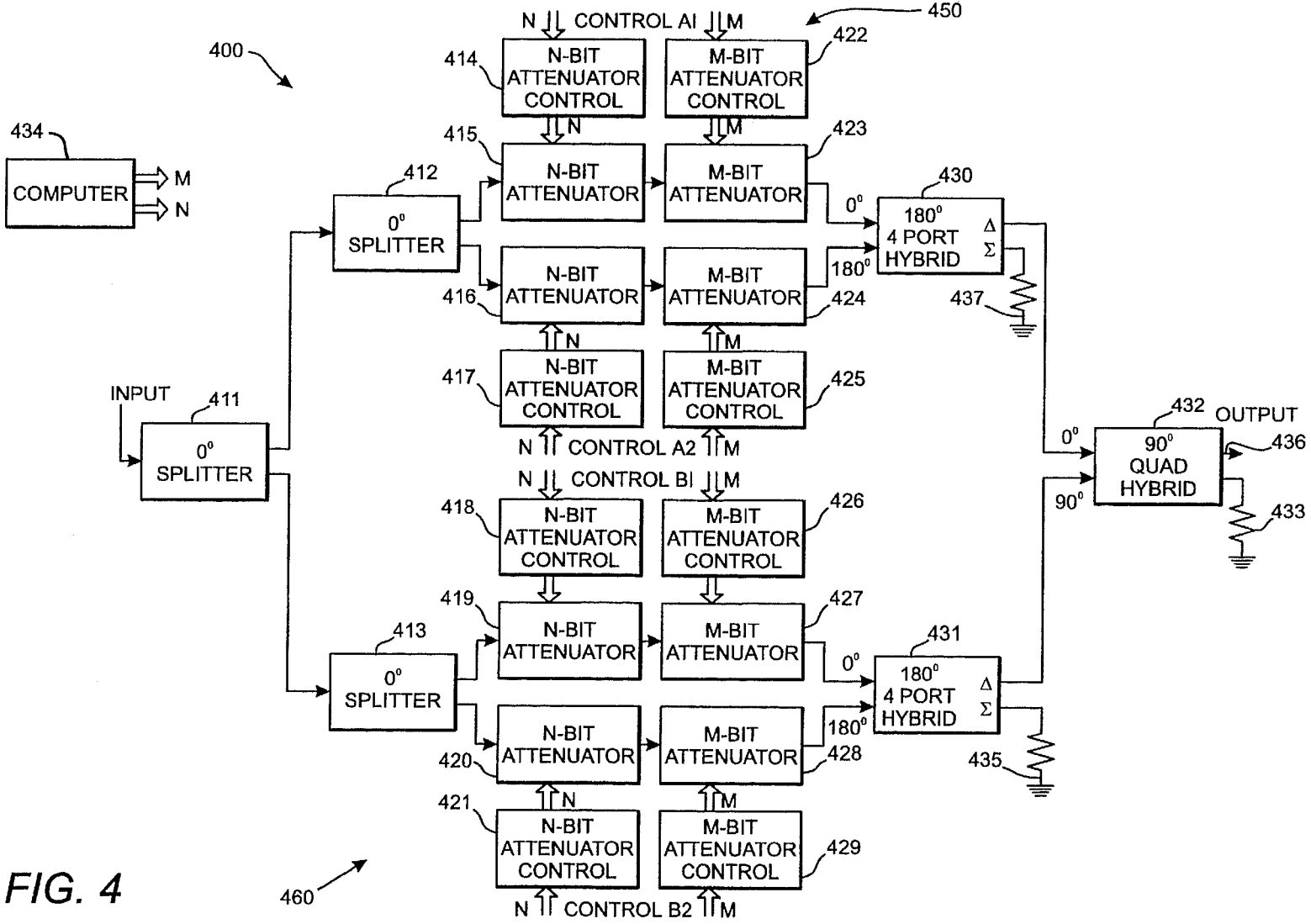
FIG. 4 is a block diagram of the vector modulator of FIG. 3.

As shown in FIG. 4, the vector modulator 400 is comprised of an initial 0° splitter 411 which receives a signal inputted from one of the antenna elements. Downstream 0° splitters 412 and 413 essentially produce two copies of the signal received at their input, with an accompanying 3-dB drop in amplitude. The signal in each channel is again replicated and passed into four identical channels leading from the 0° splitters 412 and 413, again with a 3-dB drop in each channel.

A single 4:1 splitter could have been used in place of the two 2:1 splitters 412 and 413, but the accuracy of 2:1 splitters has been found to be greater than the accuracy of 4:1 splitters.

In order to match the delays and amplitude changes in each channel of the vector modulator 400, it is important that the same components be used in each channel. Each channel is then inputted to a cascaded series of digitally controlled N-bit and M-bit attenuators 415, 423; 416, 424; 419, 427; and 420, 428, respectively. The N-bit and M-bit attenuators are controlled by N-bit and M-bit attenuator control devices 414, 422; 417, 425; 418, 426; and 421, 429, respectively. The N-bit attenuators can, for example, attenuate over a 63-dB range using, for example, six control bits (N=6). The M-bit attenuators can, for example, attenuate over a 16.5-dB range using, for example, eight control bits (M=8). Thus, the amplitude can be changed in each channel of the vector modulator 400 over an 80-dB range, with an accuracy within 1/10 dB. In other words, the signals in each channel can be controlled essentially to the ground level. These attenuators can be considered as precision resistive networks switched by high speed relays, although other implementations are possible, as will be apparent to those skilled in this art. Of course, N and M may be chosen to have a greater resolution, or the attenuators may be chosen to have a greater range than in the example given above, without in any way departing from the spirit of the invention.

Control of the amplitude in each channel is effectuated with the vector control words A1 ($N_{414}+M_{422}$), A2 ($N_{417}+M_{425}$), B1 ($N_{418}+M_{426}$), and B2 ($N_{421}+M_{429}$). By judiciously manipulating the vector control words, an operator of the electronically steerable beam-forming system can deepen a cardioid null at any azimuth angle, by nulling out both horizontal and vertical channels, irrespective of the azimuth angle.

For greater efficiency, the vector control words can be stored and generated in the computer 434. Once the A1, A2, B1 and B2 parameters found to be optimal for selected coordinates are stored in memory, if signals are detected which originate from positions intermediate to the stored coordinates appear, a mathematical manipulation can be carried out to interpolate linearly the A1, A2, B1 and B2 values which would deepen the null at that location. The interpolation can be done using many well-known techniques, such as splines and polynomials. Thus, nulls can be steered electronically at high speed, even if the signal originates from coordinates for which appropriate vector control words have not previously been calculated. In like manner, it is possible to use a table look-up scheme to store vector control words for various orientations and center frequencies to allow for almost immediate nulling out of an interfering signal, or for the maximizing of a signal of interest.

For example, the signal of interest may be jammed by other interfering signals. By maximizing the desired signal and by attenuating the interfering signal as much as 90 dBs, the effects of jamming may be almost eliminated before the signal is ever inputted to a receiver. Of course, this beam-steering function is performed without physically changing the orientation of the antenna array. It is evident that the present invention is also useful in DF applications.

Figure 6:
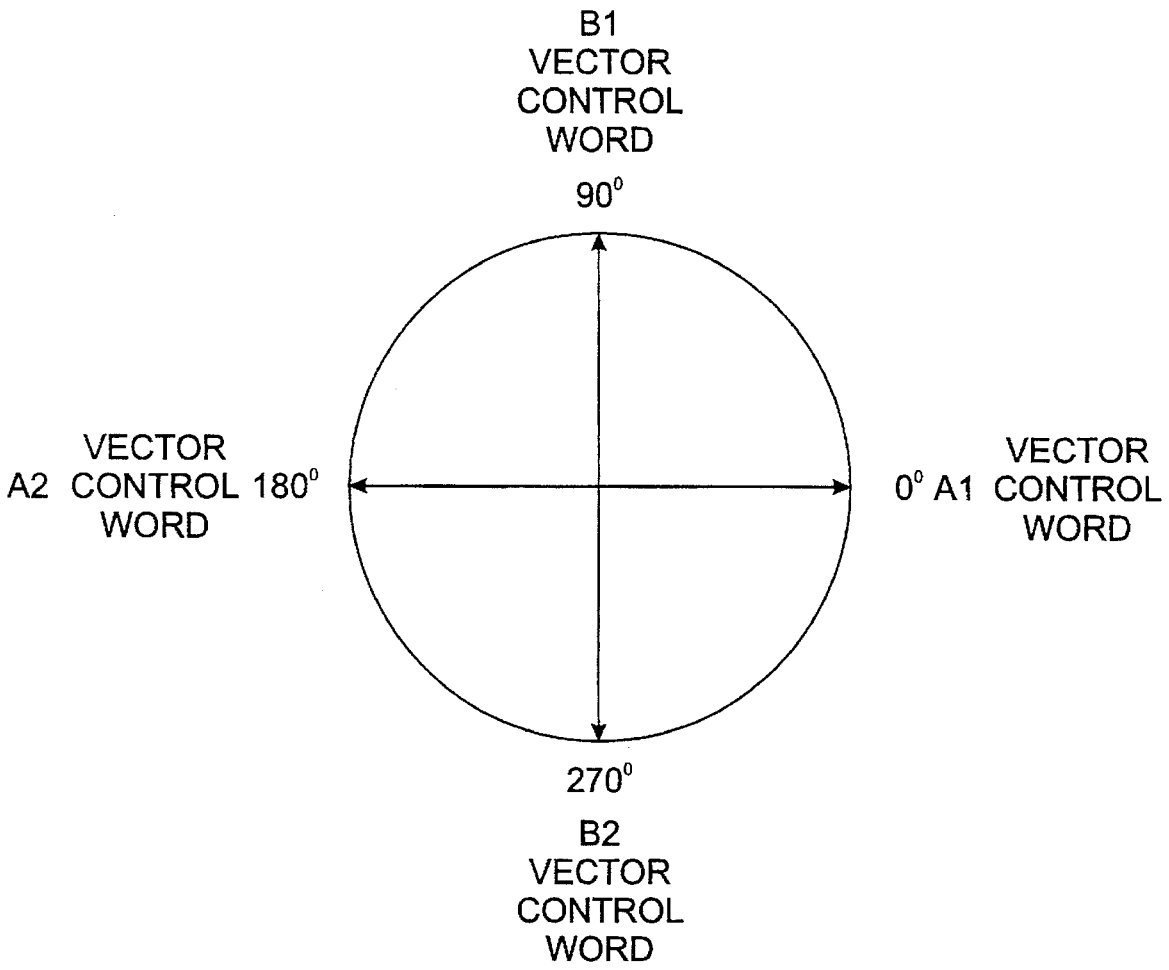
FIG. 6 is a graphical representation of the manner in which the broadband cardioid pattern may be electronically steered into any one of four quadrants using control words A1, A2, B1 and B2 of the vector modulator according to the present invention.

FIG. 6 is a graphical representation of the manner in which the broadband nulls may be electronically steered into any one of the four quadrants using the control words A1, A2, B1 and B2 of the vector modulator 400. From FIG. 6, it is easy to see how different components of an incoming signal may be de-emphasized, or even inverted by appropriately choosing the A1, A2, B1 and B2 parameters.

Returning now to FIG. 4, the signals outputted from the M-bit attenuators 423, 424 are input to the 0° and 180° ports of a 4-port hybrid 430. Simply stated, the 4-port hybrid 430 is a device which accepts two incoming signals at its input and produces, at one output (Σ) port, the sum of the input signals, and also produces, at the other output (Δ) port, the difference between the input signals. In this case, the Σ-port of the 4-port hybrid 430 is grounded via a 50 Ω resistor 437. The output is taken from the Δ-port, i.e. the difference is calculated between the signal output from the M-bit attenuator 423 and the signal output from the M-bit attenuator 424, so that the output is produced at the Δ-port.

Similarly, the difference between the signals outputted from the M-bit attenuators 427 and 428 is output at a Δ-port of another 4-port hybrid 431. The two signals outputted from the 4-port hybrids 430 and 431 are then inputted to the final stage of the vector modulator 400, i.e. a quadrature hybrid 432.

As indicated previously, the quadrature hybrid combines two signals that are in quadrature, giving only one signal out. The quad hybrid 432 has a 0° input and a 90° input. The vector sum of the signals inputted to the quad hybrid 432 is produced at one output port 436 while the other output is grounded via a 50 Ω resistor 433.

The quad hybrid 432 has exceptionally broad bandwidth with an accuracy within one degree over the full military temperature range.

FIG. 5 is a diagram of a second preferred embodiment of the electronically steerable beam-forming system showing the Z-axis azimuth developed by using axial symmetry to extend to the 3-D implementation with the X-, Y-, and Z-axes. This second system 500 makes use of three dipole antennas and three loop antennas to vary and to control the azimuth around the Z-axis, the elevation around the Y-axis, and the elevation around the X-axis. In this manner, the incoming wide band signal can be exploited in a polarizationally diverse manner to pick up signals regardless of their polarization.

The signals induced on each of X-, Y-, and Z-loops 511, 512 and 516 and on each of X-, Y-, and Z-dipoles 514, 515, and 513 are sent to 1:3 splitters 517–522 to provide, in effect, three copies of each signal to a connection matrix 523, with an accompanying loss in signal amplitude.

The connection matrix 523 simply routes the split signals induced on the loop and dipole antennas to a bank of six quad hybrids, six vector modulators, and six 2:1 combiners which form six networks 524–529 that are divided into three groups in order to obtain the azimuth around the Z-axis, the elevation around the Y-axis, and the elevation around the X-axis of the incoming signal. Each group has one channel for horizontal polarization and another channel for vertical polarization.

In each network 524–529, for vertical polarization in the azimuth around the Z-axis group, the signals induced on the X-loop 511 and Y-loop 512 are inputted into the quad hybrid, whereas the sole signal induced on the Z-dipole 513 is inputted to the vector modulator. The vector modulator is controlled by a control word "CNTR" containing the A1, A2, B1 and B2 parameters. The output of each quad hybrid will be a Mode 1 signal which is combined in a 2:1 combiner with a Mode 0 signal that is the output of the vector modulator. As in FIG. 2, the output of the vector modulator in each network 524–529 is delayed and attenuated to match its output with the magnitude and phase of the output from the quad hybrid. The signals from each group, i.e. the vertical and horizontal channels, are then combined in downstream 2:1 combiners 530, 531 and 532. Finally, the signals representative of the azimuth around the Z-axis, the elevation around the Y-axis, and the elevation around the X-axis are combined in a 3:1 combiner 533. The output of the 3:1 combiner 533 is only then input to a receiver or receivers 534. If the situation warrants, additional filtering and/or amplifying may be performed on the combined signal before it is sent to the receivers 534.

Alternatively, instead of combining the vertical and horizontal polarization channels of each group, each channel may be inputted into a separate receiver 534, or the signal component representative of the azimuth and each signal component representative of the elevation may also be separately inputted to an individual receiver 534, or any combination thereof.

In yet another modification, switches may be installed at the output of each polarization channel to de-emphasize one polarization with respect to another. For example, when signals bounce off the earth's ionosphere, the resulting polarization pattern may look like an ellipse. In some applications, it may be useful to de-emphasize one polarization by attenuating it. With a switch, infinite attenuation is achieved. This arrangement makes it possible to switch out completely the vertical and horizontal polarization on any X-, Y- or Z-axis.

It is important to note that the processing is done on the signals induced on the sensor array elements directly at the RF level and not at the IF level. Also, the signal processing is performed in real time with digitally set vector control words only. Indeed, the incoming signals are not sampled in any way prior to being inputted to the receivers 534 of the system 500.

In conclusion, the present invention is a method and a device to develop steerable beams which are decomposed into modal antenna patterns. The individual antenna modal patterns are combined in such a way as to allow formation of cardioid beams, each of which has a broadband front and deep wide band nulls.

While the present invention has been described with reference to two particular embodiments, it is not to be restricted to them. Any limitations are set forth only by the appended claims. It is to be appreciated that those persons skilled in the art can change or modify the disclosed embodiments without departing from the scope and spirit of the present invention.

For example, the invention is not limited to a six-antenna array. Any number of sensors can be used to exploit the signals induced thereon in a polarizationally diverse manner. The sensor elements need not, for the purposes of the present invention, be co-located. Likewise, those persons of ordinary skill in the art will readily recognize that the present invention is applicable to any transducer array, such as an array of either piezoelectric crystal transducers or pressure transducers. The skilled artisan will also readily recognize that the present invention can be used in the acoustical frequency range, and it is thus not limited to radio frequency (RF) ranges.

Likewise, the present invention is applicable to subacoustic frequency ranges by exploiting, in a polarizationally diverse manner, the low frequency signals induced on an array of acoustic transducers, or on an array of hydrophones, for example, mounted orthogonally relative to one another.

The present invention should, therefore, not be limited to antennas and RF signals, because it is equally applicable to signals induced on any sensor array, irrespective of the frequency range of the induced signals.

I claim:

1. Beam-forming and steering system comprising:

a multielement sensor array including a first sensor of a first type, a second sensor of the first type, a third sensor of the first type, a first sensor of a second type, a second sensor of the second type, and a third sensor of the second type;

said first, second and third sensors of the first type and the second type each being aligned along an X, Y and Z axis, respectively;

a plurality of 1:3 splitter means, one for each of the first, second and third sensors of the first type and the second type, for splitting signals induced on each of the first, second, and third sensors of the first type and the second type into three separate split signals;

a connection matrix means, connected to each of the plurality of 1:3 splitter means, for grouping the split signals into a first, second, and third group representative of elevation around the Z,Y and X axis, respectively, each of the first, second and third group being further grouped into polarization channels having signals representative of vertical polarization and horizontal polarization;

a first, second, third, fourth, fifth and sixth network, each being connected to the connection matrix means, and each including:

a quadrature means for combining two induced signals in quadrature and for outputting a quadrature combining output signal;

a vector modulating means for outputting a vector modulating output signal of changed amplitude and phase relative to signals input to the vector modulating means;

a 2:1 means for combining the quadrature combining output signal and the vector modulating output signal and also for outputting a combined network output signal;

the signals representative of the vertical polarization being connected to the first, third and fifth network, respectively;

said signals representative of the horizontal polarization being connected to the second, fourth and sixth network, respectively;

a first, second and third 2:1 means, connected to the first and second network, to the third and fourth network, and to the fifth and sixth network, respectively, for combining a network output signal of the first and second networks into an output signal representative of azimuth around the Z axis, for combining a network output signal of the third and fourth network into an output signal representative of elevation around the Y axis, and for combining a network output signal of the fifth and sixth network into an output signal representative of elevation around the X axis, respectively.

2. Beam-forming and steering system according to claim 1, wherein the first, second and third sensors of the first type are dipole antennas.

3. Beam-forming and steering system according to claim 1, wherein the first, second and third sensors of the second type are loop antennas.

4. Beam-forming and steering system according to claim 1, further comprising:

a 3:1 means for combining the output signals representative of the azimuth around the Z axis, the elevation around the Y axis, and the elevation around the X axis, respectively, into a 3:1 output signal;

wherein said 3:1 output signal is input to at least one means for receiving and further processing the 3:1 output signal.

5. Beam-forming and steering system according to claim 1, further comprising:

a first receiver means for intaking the signal representative of the azimuth around the Z axis;

a second receiver means for intaking the signal representative of the elevation around the Y axis; and a third receiver means for intaking the signal representative of the elevation around the X axis;

said first, second, and third receiver means further processing the signal representative of the azimuth around the Z axis, the signal representative of the elevation around the Y axis, and the signal representative of the elevation around the X axis, respectively.

6. Beam-forming and steering system according to claim 1, further comprising:

first, second and third means, connected to the polarization channels of the first, second and third groups, for selectively attenuating the polarization channels of the first, second and third groups, whereby one polarization channel is de-emphasized with respect to at least one other polarization channel.

7. Beam-forming and steering system according to claim 6, wherein the first, second and third selective attenuating means each includes a controllable switch means for achieving infinite attenuation when the controllable switch means is in an open position.

8. Beam-forming and steering system according to claim 1, wherein the vector modulating means comprises:

first means for splitting the signals induced on the multielement sensor array into a first channel and a second channel, redefined as real components and imaginary components of the induced signals, respectively;

a first gain control means, connected to the first channel, for selectively amplifying the real components of the induced signals;

a second gain control means, connected to the second channel, for selectively amplifying the imaginary components of the induced signals; and a quadrature combining means for producing a vector sum of the selectively amplified real and imaginary components.

9. Beam-forming and steering means according to claim 8, wherein the vector modulating means further comprises:

second means for splitting the real components on the first channel into third and fourth channels; and third means for splitting the imaginary components on the second channel into fifth and sixth channels;

said first gain control means, being connected to the third and fourth channels, for selectively amplifying the real components of the signals on each of the third and fourth channels;

the second gain control means, being connected to each of the fifth and sixth channels, for selectively amplifying the imaginary components of the signals on each of the fifth and sixth channels.

10. Beam-forming and steering means according to claim 9, wherein the vector modulating means further comprises:

first means, connected to outputs of the first gain control means, for producing a first difference signal corresponding to a difference between the selectively amplified real components of the signals on the third and fourth channels; and second means, connected to outputs of the second gain control means, for producing a second difference signal corresponding to a difference between the selectively amplified imaginary components of the signals on the fifth and sixth channels;

the first and second difference signals being input to a 0° and a 90° input of the quadrature combining means, respectively.

11. Beam-forming and steering system according to claim 9, wherein the first gain control means comprises:

a first means for attenuating the real component of the induced signals on the third channel;

a first attenuator controlling means, connected to the first attenuating means, for controlling a degree of attenuation of the first attenuating means by a first control word input to the first attenuator controlling means;

a second means for attenuating the real components of the induced signals on the fourth channel; and a second attenuator controlling means, connected to the second attenuating means, for controlling a degree of attenuation of the second attenuating means by a second control word input to the second attenuator controlling means.

12. Beam-forming and steering system according to claim 9, wherein the second gain control means comprises:

a third means for attenuating the imaginary components of the induced signals on the fifth channel;

a third attenuator controlling means, connected to the third attenuating means, for controlling a degree of attenuation of the third attenuating means by a third control word input to the third attenuator controlling means;

a fourth means for attenuating the imaginary components of the induced signals on the sixth channel; and a fourth attenuator controlling means, connected to the fourth attenuating means, for controlling a degree of attenuation of the fourth attenuating means by a fourth control word input to the fourth attenuator controlling means.

13. Beam-forming and steering system according to claim 11, wherein the first attenuating means comprises:

a first N-bit attenuating means for selectively attenuating the real components of the induced signals on the third channel with a resolution of $1/2^N$; and a first M-bit attenuating means for selectively attenuating the real components of the induced signals on the third channel with a resolution of $1/2^M$;

said first N-bit attenuating means and the first M-bit attenuating means being connected in series;

wherein the first attenuator controlling means comprises:

a first N-bit attenuator controlling means, connected to the first N-bit attenuating means, for selectively controlling a degree of attenuation of the first N-bit attenuating means; and a first M-bit attenuator controlling means, connected to the first M-bit attenuating means, for selectively controlling a degree of attenuation of the first M-bit attenuating means.

14. Beam-forming and steering system according to claim 11, wherein the second attenuating means comprises:

a second N-bit attenuating means for selectively attenuating the real components of the induced signals on the fourth channel with a resolution of $1/2^N$; and a second M-bit attenuating means for selectively attenuating the real components of the induced signals on the fourth channel with a resolution of $1/2^M$;

said second N-bit attenuating means land the second M-bit attenuating means being connected in series;

wherein the second attenuator controlling means comprises:

a second N-bit attenuator controlling means, connected to the second N-bit attenuating means, for selectively controlling a degree of attenuation of the second N-bit attenuating means; and a second M-bit attenuator controlling means, connected to the second M-bit attenuating means, for selectively controlling a degree of attenuation of the second M-bit attenuating means.

15. Beam-forming and steering system according to claim 12, wherein the third attenuating means comprises:

a third N-bit attenuating means for selectively attenuating the imaginary components of the induced signals on the fifth channel with a resolution of $1/2^N$; and a third M-bit attenuating means for selectively attenuating the imaginary components of the induced signals on the fifth channel with a resolution of $1/2^M$;

said third N-bit attenuating means and the third M-bit attenuating means being connected in series;

wherein the third attenuator controlling means comprises:

a third N-bit attenuator controlling means, connected to the third N-bit attenuating means, for selectively controlling a degree of attenuation of the third N-bit attenuating means; and a third M-bit attenuator controlling means, connected to the third M-bit attenuating means, for selectively controlling a degree of attenuation of the third M-bit attenuating means.

16. Beam-forming and steering system according to claim 12, wherein the fourth attenuating means comprises:

a fourth N-bit attenuating means, for selectively attenuating the imaginary components of the induced signals on the sixth channel with a resolution of $1/2^N$; and a fourth M-bit attenuating means, for selectively attenuating the imaginary components of the induced signals on the sixth channel with a resolution of $1/2^M$;

said fourth N-bit attenuating means and the fourth M-bit attenuating means being connected in series;

wherein the fourth attenuator controlling means comprises:

a fourth N-bit attenuator controlling means, connected to the fourth N-bit attenuating means, for selectively controlling a degree of attenuation of the fourth N-bit attenuating means; and a fourth M-bit attenuator controlling means, connected to the fourth M-bit attenuating means, for selectively controlling a degree of attenuation of the fourth M-bit attenuating means.

17. Beam-forming and steering system according to claim 13, wherein the first control word includes a first N-bit word and a first M-bit word, being input to the first N-bit attenuator controlling means and to the first M-bit attenuator controlling means, respectively.

18. Beam-forming and steering system according to claim 14, wherein the second control word includes a second N-bit word and a second M-bit word, being input to the second N-bit attenuator controlling means and to the second M-bit attenuator controlling means, respectively.

19. Beam-forming and steering system according to claim 15, wherein the third control word includes a third N-bit word and a third M-bit word, being input to the third N-bit attenuator controlling means and to the third M-bit attenuator controlling means, respectively.

20. Beam-forming and steering system according to claim 16, wherein the fourth control word includes a fourth N-bit word and a fourth M-bit word, being input to the fourth N-bit attenuator controlling means and to the fourth M-bit attenuator controlling means, respectively.

* * * * *

UNITED STATES PATENT AND TRADEMARK OFFICE

CERTIFICATE OF CORRECTION

PATENT NO. : 5,661,489
DATED : Aug. 26, 1997
INVENTOR(S) : Leonard Baker

It is certified that error appears in the above-indentified patent and that said Letters Patent is hereby corrected as shown below:

Cover page, left column, Section [75], "Bethesda, Md." should be --Spring Lake Heights, N.J.--;

left column, Section [56], line 13, "333/16X" should be --333/164--; and right column, line 6, "Pham" should be --Phan--.

Column 5, line 18, "land" should be --and--.

Column 12, claim 11, line 4, "land" should be --and--.

Signed and Sealed this
Sixteenth Day of December, 1997

Bruce Lehman

*Attest:*

BRUCE LEHMAN

*Attesting Officer*

*Commissioner of Patents and Trademarks*